United States Patent [19]

Dolby

[11] Patent Number: 4,771,936

[45] Date of Patent: Sep. 20, 1988

[54] BOX TOP LID

[76] Inventor: Timothy S. Dolby, 5 Till St., Enfield, Conn. 06082

[21] Appl. No.: 87,642

[22] Filed: Aug. 20, 1987

[51] Int. Cl.[4] ..... B65D 43/16

[52] U.S. Cl. ..... 229/123.1; 229/125.08; 229/125.11; 229/125.16; 229/125.21; 229/125.23; 229/125.37

[58] Field of Search ..... 229/125.08, 125.11, 229/125.16, 125.21, 125.23, 125.37, 125.39, 123.1

[56] References Cited

U.S. PATENT DOCUMENTS

| | | | |
|---|---|---|---|
| 902,705 | 11/1908 | Anderson | 229/125.11 |
| 1,508,878 | 9/1924 | Evalenko | 229/125.11 |
| 1,767,742 | 6/1930 | Case | 229/125.11 |
| 2,108,431 | 2/1938 | Cornwall | 229/125.08 |
| 2,449,196 | 9/1948 | Bent | 229/125.16 |
| 2,889,976 | 6/1959 | Cantfort | 229/125.11 |
| 3,180,552 | 4/1965 | Atkinson, Jr. | 229/125.08 |
| 3,265,282 | 8/1966 | Maxwell | 229/125.08 |
| 3,298,590 | 1/1967 | Gray | 229/125.08 |
| 3,550,837 | 12/1970 | Erb | 229/125.37 |
| 4,458,810 | 7/1984 | Mahoney | 229/125.16 |

*Primary Examiner*—Stephen Marcus
*Assistant Examiner*—Gary E. Elkins
*Attorney, Agent, or Firm*—Richard L. Miller

[57] ABSTRACT

This box top lid is designed to enable a person to easily open a box containing a food or other product. Primarily, it consists of a main body with a gasket within for keeping insects out and helping the product to stay fresher longer. It also includes a pair of mating hook and loop pile fasteners that are fastened to both the main body and the product box, for keeping the box opening thoroughly closed after using.

3 Claims, 1 Drawing Sheet

BOX TOP LID

BACKGROUND OF THE INVENTION

The instant invention relates generally to cartons, and more particularly, to a box top lid.

Numerous box pouring lids have been provided in the prior art that are adapted to conveniently close a box. For example, U.S. Pat. Nos. 4,420,111 of Hament, 4,433,808 of Gordon et al, and 4,583,679 of Johnson all are illustrative of such prior art. While these units may be suitable for the particular purpose to which they address, they would not be as suitable for the purpose of the present invention as hereafter described.

SUMMARY OF THE INVENTION

A primary object of the present invention is to provide a box top lid that will overcome the shortcomings of the prior art devices.

Another object is to provide a box top lid, which will of such design, as to be unique and attractive, for being employed on any kind of box, whether it be cereal, cat food, etc.

An additional object is to provide a box top lid which will be of such design, as to eliminate mutilation of the box and will keep moisture out and freshness in, while taking less effort to open and close, which is desirable particularly by the blind, arthritic, etc.

A further object is to provide a box top lid that is simple and easy to use.

A still further object is to provide box top lid that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figures 1, 2, 3, 4, 5, 6, 7, 8, 9, 10, 11, 12, 13, 14:
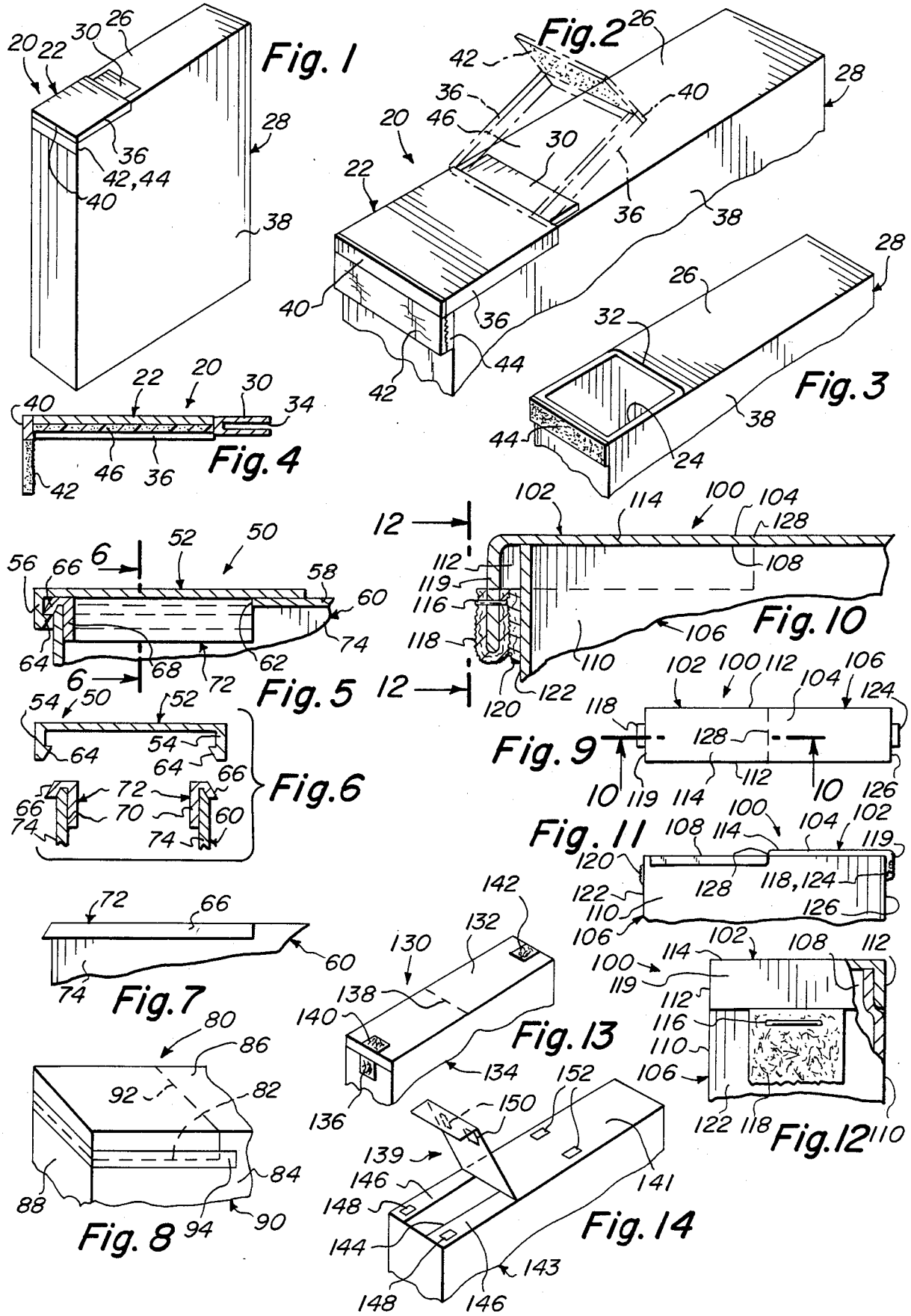
FIG. 1 is a diagrammatic perspective view of the instant invention.
FIG. 2 is an enlarged fragmentary perspective view similar to FIG. 1, but shown in an open position in phantom.
FIG. 3 is similar to FIG. 2, but showing the top structure removed from the box opening.
FIG. 4 is a horizontal elevational cross sectional side view of the top structure.
FIG. 5 is fragmentary elevational cross sectional view of a first modified from of the top structure.
FIG. 6 is an exploded cross sectional view taken along line 6—6 of FIG. 5.
FIG. 7 is a fragmentary elevational side view of the box of FIG. 6 with the top cover removed therefrom.
FIG. 8 is a diagrammatic fragmentary perspective of a second modified form of the invention.
FIG. 9 is a diagrammatic top plan view of a third modified form of the instant invention.
FIG. 10 is an enlarged cross sectional view taken along line 10—10 of FIG. 9 showing the stapled and folded mating hook and loop pile fastener material for locking the box closed or in full opened position.
FIG. 11 is a fragmentary elevational diagrammatic side view of the third modified form of the invention, with the cover in full folded back position and locked with hook and loop pile mating fastener material.
FIG. 12 is a view taken along line 12—12 of FIG. 10.

FIG. 13 is a fragmentary perspective view of a fourth modified form of the invention, and illustrates a plurality of hook and loop pile fasteners locking the cover in full open and closed positions; and FIG. 14 is a diagrammatic view similar to FIG. 13, but illustrates a fifth modification of the instant invention, which employs magnetic material for holding the top cover in full open and closed positions.

DETAILED DESCRIPTION OF THE PREFERRED EMBODIMENTS

Turning now descriptively to the drawings, in which like reference characters denote like elements throughout the several views, a lid 20 is shown to include a rectangular main body 22 for covering an opening 24 in a top portion 26 of a box 28. A channel 30 is provided and fixedly secured at one longitudinal edge to a rear end of a main body 22, and an edge portion 32 of top portion 26 is fixedly secured in the opening 34 of channel 30. Longitudinal side members 36 are integrally attached to main body 22, for overlapping engagement with sides 38 of box 28, and an end member 40 is fixedly secured at one longitudinal face, to a forward end of main body 22 and an end of side members 36. A pair of mating hook and loop pile fastener strips 42 and 44 are provided and one fastener strip 44 is fixedly secured to the upper outside surface of the front end of the box 28, and when lid 20 is closed, fastener strips 42 and 44 retain lid 20 in closed condition.

A foam plastic gasket 46 is provided and fixedly secured to the bottom surface of main body 22, providing for a secure seal when lid 20 is closed, and gasket 46 engages with top edges of opening 24 provided in box 28.

In use, the mating hook and loop pile fastener strips 42 and 44 are dis-engaged with each other and the lid 20 is pivoted rearwards at the channel 30. When opened, lid 20 tends to remain rearward by the inherent stiffness of the channel 30, so as not to interfere with the outward flow of the product contained in the box 28.

After the desired amount of the product has been dispensed, lid 20 is pivoted closed and fastener strip 42 is again engaged with mating fastener strip 44, and the gasket 46 firmly seals opening 24 of the box 28.

Referring now to FIGS. 5 through 7, a first modified form of lid 50 consists of a main body 52 having a pair of side walls 54 and a front end wall 56 integrally attached. The rear portion of main body 52 is fixedly secured to the top wall 58 of a box 60, and main body 52 covers cut-out opening 62 in the forward end of box 60. An upwardly facing hook lip 64 is integrally attached to the bottom of walls 54 and 56, for removable engagement with a similar and upwardly facing hook lip 66 provided on a front wall 68 and side walls 70 of an insert 72.

Insert 72 is received in the opening 62 of the box 60, and the walls 68 and 72 thereof, are fixedly secured to the walls 74 of box 60.

In use, the front end of main body 52 is lifted by the user, causing dis-engagement of the lips 64 and 66. After dis-engagement, lid 50 is pivoted rearward for enabling the contents to be dispensed from the opening 62. After use, lid 50 is again pivoted closed by hand pressure of the user on top of the main body 52. When this pressure is applied, the lips 64 and 66 again engage with each other for complete sealing of the opening 62 in box 60.

Looking now at FIG. 8 of the drawing, a second modified form of lid 80 is formed by a cut 82 in the side walls 84 which extends partially to the top wall 86. The cut 82 also extends across the front wall 88 of the box 90 and a partially perforate bend line 92 is provided in the top wall 86 for enabling lid 80 to fold rearward. An adhesive backed tape 94 is provided and seals lid 80 to box 90.

In use, the tape 94 is first removed from box 90 and lid 80 is lifted for pouring the contents from the opening defined by the lid 80. After the desired contents have been removed, the tape 94 is again employed to reseal box 90.

Referring now to FIGS. 9 through 12, a third modified form of lid 100 is shown to include a main body 102 formed in the top wall 104 of a box 106, and the side walls 110 are recessed at their top portions for being flush with the side walls 112 of main body 102. A lid 114 is integrally attached to and extends forward of main body 102, to cover opening 108 and is provided with a staple 116 that secures on of a pair of mating hook and loop pile fasteners strips 118 and 120 to the structure. Fastener strip 118 is folded and received on the end of lip 110, with the fastening surface on the outside, before being secured thereto by staple 116, and fastener strip 120 is fixedly secured to the outside of the upper portion of the front wall 122 of the box 106. A third fastener strip 124 is fixedly secured to the rear wall 126 of the box 106, for locking lid 100 in the full open position.

In use, the user peels fasteners 118 and 120 apart with a finger and the pivots lid 114 upward along the bend line 128 inscribed and defining lid 114 from the rest of the top wall 104 of the box 106. After the above, lid 114 is engaged by its lip 119 with the third fastener 124 on the rear of box 106, thus securing lid 114 rearward.

After removing some of the contents of the box 106, fastener strips 118 and 124 are peeled apart and lid 114 is again pivoted and the fastener strips 118 and 120 are again engaged for securely covering opening 108.

It shall be noted, that prior to pivoting lid 114 rearward, the side corners of the lip 114 must be ruptured, so as to enable the lip 114 to fold back for fastener engagement with the third fastener 124.

Looking now at FIG. 13, a fourth modified form of lid 139 is integrally attached to top wall 132 of the box 134, and mating hook and loop pile fasteners 136 (one of which is shown), are provided for holding lid 130 closed.

A bend line 138 is provided for pivoting lid 130 rearward and a similar fastener 140 is secured to the forward end of lid 130 for mating engagement with another similar fastener 142 that is fixedly secured to the rear of top wall 132, enabling engagement for keeping lid 130 rearward when pouring the contents of box 134.

In use, lid 130 is pivoted rearward and held in place by fasteners 140 and 142, in a similar manner as was heretofore described of modified form of lid 100.

Referring now to FIG. 14, a fifth modified form of lid 139 is integrally attached to top wall 141 of a box 143 and is pivotal rearward. Lid 139 covers an opening 144 defined by a pair of lips 146 attached to sides of box 143 and a pair of ferrous metal strips 148 are fixedly secured to the forward portions of lips 146 for magnetic attraction to a pair of aligned magnetic strips 150 fixedly secured to lid 139, the arrangement enabling full closure of lid 139. A similar pair of ferrous metal strips 152 are fixedly secured to top wall 141 for magnetic attraction to magnetic strips 150 of lid 139, for holding lid 139 rearward.

In use, lid 139 is lifted upward by a user from the forward end, which disengages the ferrous strips from the magnetic holding of the magnetic strips 150. After opening, lid 130 is pivoted all the way rearward where the magnetic strips 150 will magnetically hold onto the ferrous metal strips 152. In sealing box 143, the reverse is effected.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A box top lid, comprising, a main body, for sealing a pour opening in a box, a channel secured to said main body, for being received on a portion of a top wall of said box, a pair of mating hook and loop pile fasteners secured to said main body and said box, for rendering said box closed, and a gasket secured in said main body, for providing a means of preventing entry of insects and keeping a product in said box fresher longer, wherein said channel is fixedly secured at a closed longitudinal edge to a rear end of said main body and said portion of said top wall is fixedly secured in said channel, and said main body is pivotal along said closed longitudinal edge of said channel.

2. A box top lid as set forth in claim 1, wherein said main body includes a front end wall that is fixedly secured to a front edge of said main body, and a pair of side walls are integrally attached to longitudinal side edges of said main body, and said pair of side walls of said main body overlap side walls of said box, and said gasket is fixedly secured at one face to a bottom surface of said main body and engages with top edges of the pour opening when said lid is closed on said box.

3. A box top lid as set forth in claim 2, wherein a longitudinal side edge of one of said pair of mating hook and loop pile fasteners is fixedly secured to said front wall of said main body and engages with another of said fasteners that is fixedly secured to a front wall of said box, and to open said box a user peels said pair of mating hook and loop pile fasteners apart and pivots said main body rearward and exposes the pour opening for dispensing contents of said box.

* * * * *